US008860417B2

(12) United States Patent
Wilson

(10) Patent No.: US 8,860,417 B2
(45) Date of Patent: Oct. 14, 2014

(54) DOWNHOLE ACTIVATION SYSTEM USING MAGNETS AND METHOD THEREOF

(75) Inventor: Kenneth Wilson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 197 days.

(21) Appl. No.: 13/351,904

(22) Filed: Jan. 17, 2012
(Under 37 CFR 1.47)

(65) Prior Publication Data

US 2013/0181719 A1 Jul. 18, 2013

(51) Int. Cl.
*G01V 3/08* (2006.01)
*G01V 3/00* (2006.01)
*E21B 31/06* (2006.01)

(52) U.S. Cl.
USPC ..... 324/346; 166/66.5

(58) Field of Classification Search
USPC ..... 324/346
See application file for complete search history.

(56) References Cited

U.S. PATENT DOCUMENTS

| | | | | |
|---|---|---|---|---|
| 8,267,167 | B2 * | 9/2012 | Lake et al. | 166/66.5 |
| 8,393,386 | B2 * | 3/2013 | Lake et al. | 166/66.5 |
| 2007/0137869 | A1 | 6/2007 | McDougall et al. | |
| 2009/0071654 | A1 | 3/2009 | O'Malley et al. | |
| 2010/0294502 | A1 | 11/2010 | Xu | |
| 2011/0120727 | A1 | 5/2011 | Lake et al. | |

FOREIGN PATENT DOCUMENTS

WO 2011005826 A1 1/2011

OTHER PUBLICATIONS

International Search Report and Written Opinion; International Application No. PCT/US2012/071733; International filing date: Dec. 27, 2012; Date of Mailing: Apr. 23, 2013; 11 pages.

* cited by examiner

*Primary Examiner* — Bot Ledynh
(74) *Attorney, Agent, or Firm* — Cantor Colburn LLP

(57) ABSTRACT

A downhole activation system within a tubular. The system includes an axially movable mover. A first magnet attached to the mover. The first magnet axially movable with the mover. A second magnet separated from the first magnet. The second magnet magnetically repulsed by the first magnet. A biasing device urging the second magnet towards the first magnet; wherein movement of the first magnet via the mover towards the second magnet moves the second magnet in a direction against the biasing device. Also included is a method of activating an activatable member in a downhole tubular.

19 Claims, 5 Drawing Sheets

DOWNHOLE ACTIVATION SYSTEM USING MAGNETS AND METHOD THEREOF

BACKGROUND

In the drilling and completion industry, the formation of boreholes for the purpose of production or injection of fluid is common The boreholes are used for exploration or extraction of natural resources such as hydrocarbons, oil, gas, water, and alternatively for CO2 sequestration.

Surface-controlled, subsurface safety valves ("SCSSV's") are typically used in production string arrangements to quickly close off the production borehole whenever a particular situation warrants such action. A usual form for an SCSSV is a flapper-type valve that includes a flapper member. The flapper-type member or simply flapper member is pivotally movable between open and closed positions within the borehole. The flapper member is actuated between the open and closed positions by a flow tube that is axially movable within the borehole. The flapper member is urged by a spring to its closed position.

The flapper member is arranged to be moved to the open position in response to a supply of hydraulic fluid pressure from a remote source at surface that acts on the flow tube. In response to the exhaust of such hydraulic fluid pressure, the flow tube is cycled back to a resting position under spring force and the flapper member is allowed to close. The SCSSV requires seals to separate portions of the SCSSV at control line pressure and portions of the SCSSV at tubing string internal pressure.

Moving the flow tube axially downhole can also be accomplished using electromagnets having concentrically arranged, tubular shaped, radially polarized magnets that interact to move the flow tube in an uphole or downhole direction. In either case, movement of the flow tube axially downhole using hydraulic or electromagnetic force must overcome the spring compression force that biases the flow tube in an uphole direction.

The art would be receptive to additional devices and methods for moving the flow tube, as well as dealing with sealing friction encountered by prior art designs.

BRIEF DESCRIPTION

A downhole activation system within a tubular, the system includes an axially movable mover; a first magnet attached to the mover, the first magnet axially movable with the mover; a second magnet separated from the first magnet, the second magnet magnetically repulsed by the first magnet; and, a biasing device urging the second magnet towards the first magnet; wherein movement of the first magnet via the mover towards the second magnet moves the second magnet in a direction against the biasing device.

A method of activating an activatable member in a downhole tubular, the method includes moving a mover, having a first magnet attached on an end thereof, in a first direction; and magnetically repulsing a second magnet, biased in a second direction opposite the first direction, in the first direction via the first magnet; wherein the activatable member is coupled to the second magnet and activated by movement of the second magnet.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
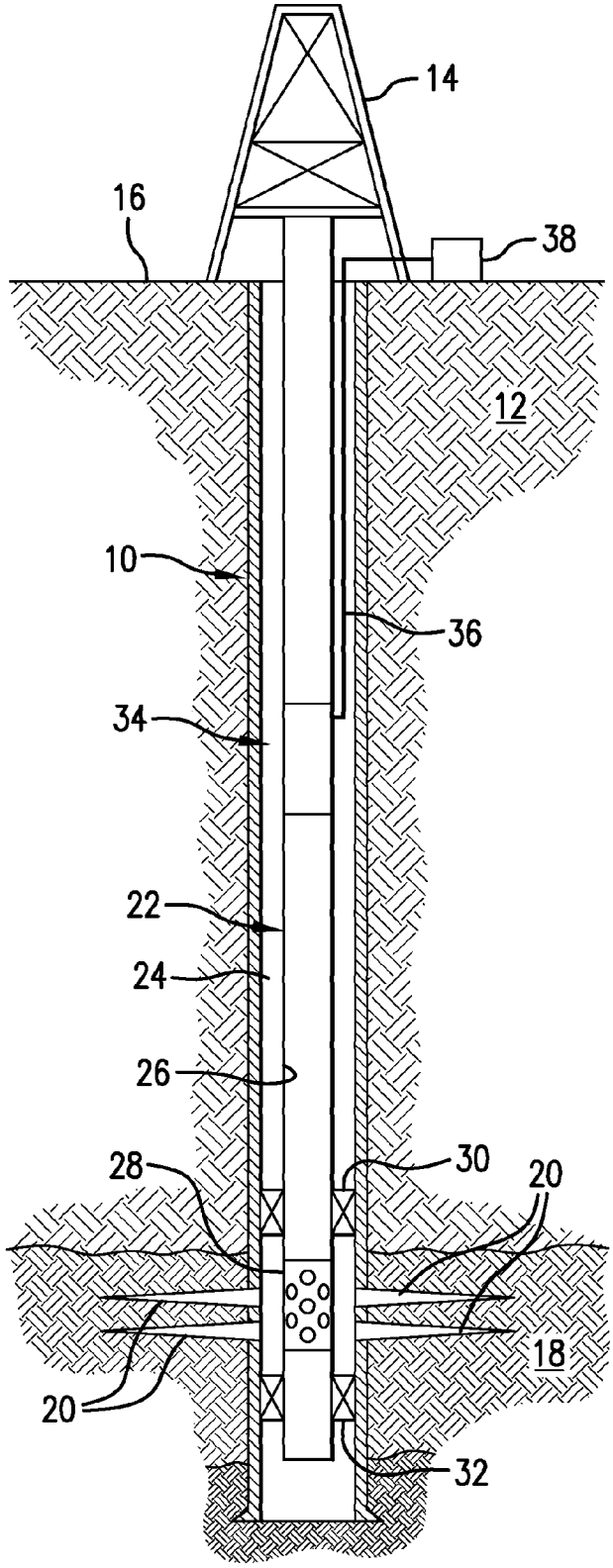
FIG. 1 depicts a cross sectional view of an exemplary production tubing string within a borehole and containing an exemplary downhole activation system.

As shown in FIG. 1, an exemplary borehole 10 is drilled through the earth 12 from a drilling rig 14 located at the surface 16. The borehole 10 is drilled down to a hydrocarbon-bearing formation 18 and perforations 20 extend outwardly into the formation 18.

An exemplary production tubing string 22 extends within the borehole 10 from the surface 16. An annulus 24 is defined between the production tubing string 22 and a wall of the surrounding borehole 10. The production tubing string 22 may be made up of sections of interconnected production tubing, or alternatively may be formed of coiled tubing. A production flowbore 26 is formed along a length of the production tubing string 22 for the transport of production fluids from the formation 18 to the surface 16. A ported section 28 is incorporated into the production tubing string 22 and is used to flow production fluids from the surrounding annulus 24 to the flowbore 26. Packers 30, 32 secure the production tubing string 22 within the borehole 10.

The production tubing string 22 also includes a downhole activation system 34 that includes an activatable member such as a surface-controlled subsurface safety valve ("SCSSV"). A SCSSV is used to close off fluid flow through the flowbore 26 and may include a flapper member, as will be described with respect to FIGS. 2 and 3. The general construction and operation of flapper valves is well known in the art. Flapper valve assemblies are described, for example, in U.S. Pat. No. 7,270,191 by Drummond et al. entitled "Flapper Opening Mechanism" and U.S. Pat. No. 7,204,313 by Williams et al. entitled "Equalizing Flapper for High Slam Rate Applications" which are herein incorporated by reference in their entireties. The downhole activation system 34, in one exemplary embodiment, is hydraulically controlled via a hydraulic control line 36 that extends from the activation system 34 to a control pump 38 at the surface 16. In another exemplary embodiment, the activation system 34 may be controlled via motor, such as an electric motor, and other control mechanisms and actuators for the activation system 34 are also employable.

Figure 2:
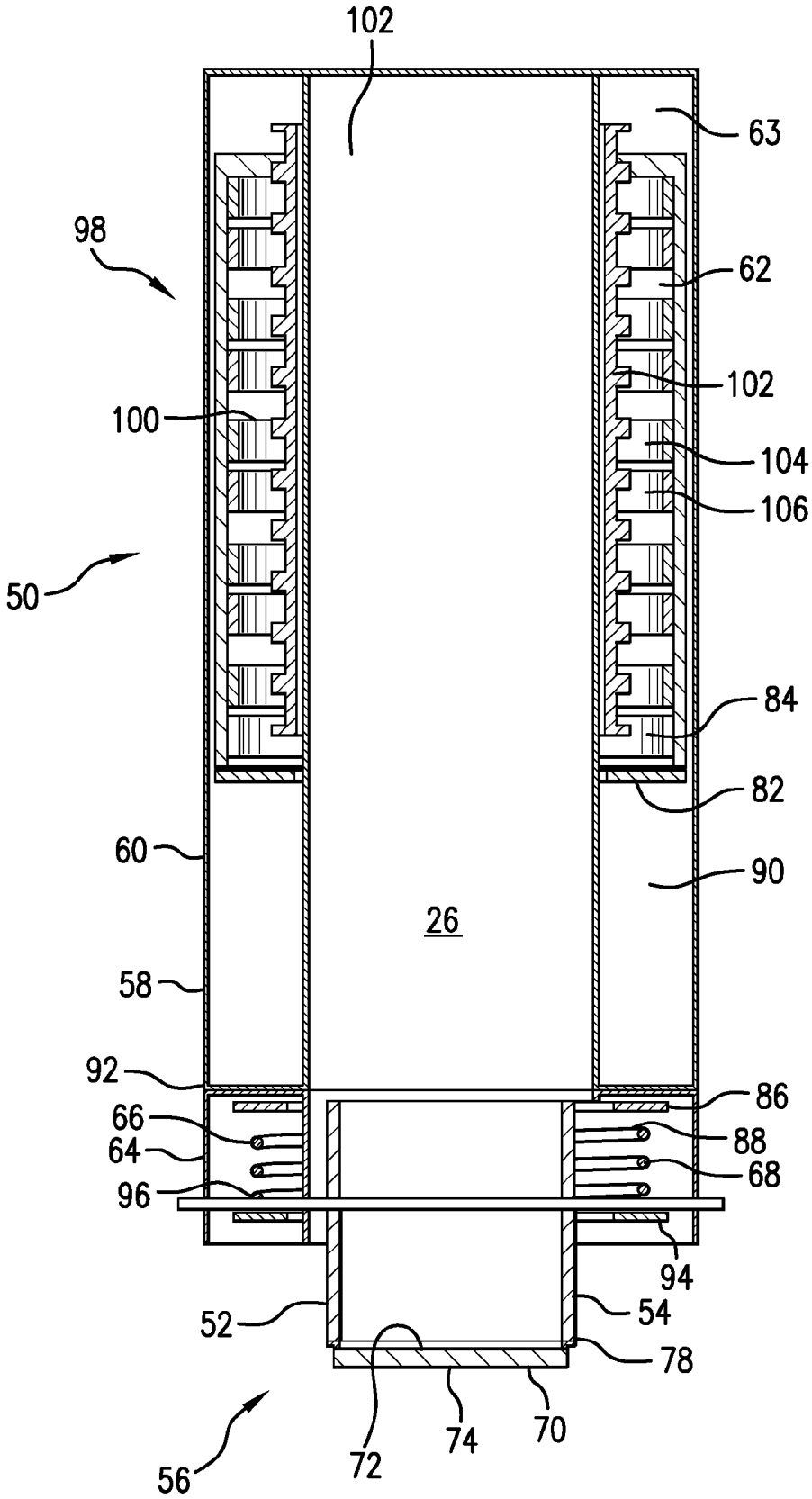
FIG. 2 depicts a cross sectional view of an exemplary embodiment of a downhole activation system used with a closure mechanism shown in a closed condition.
Figure 3:
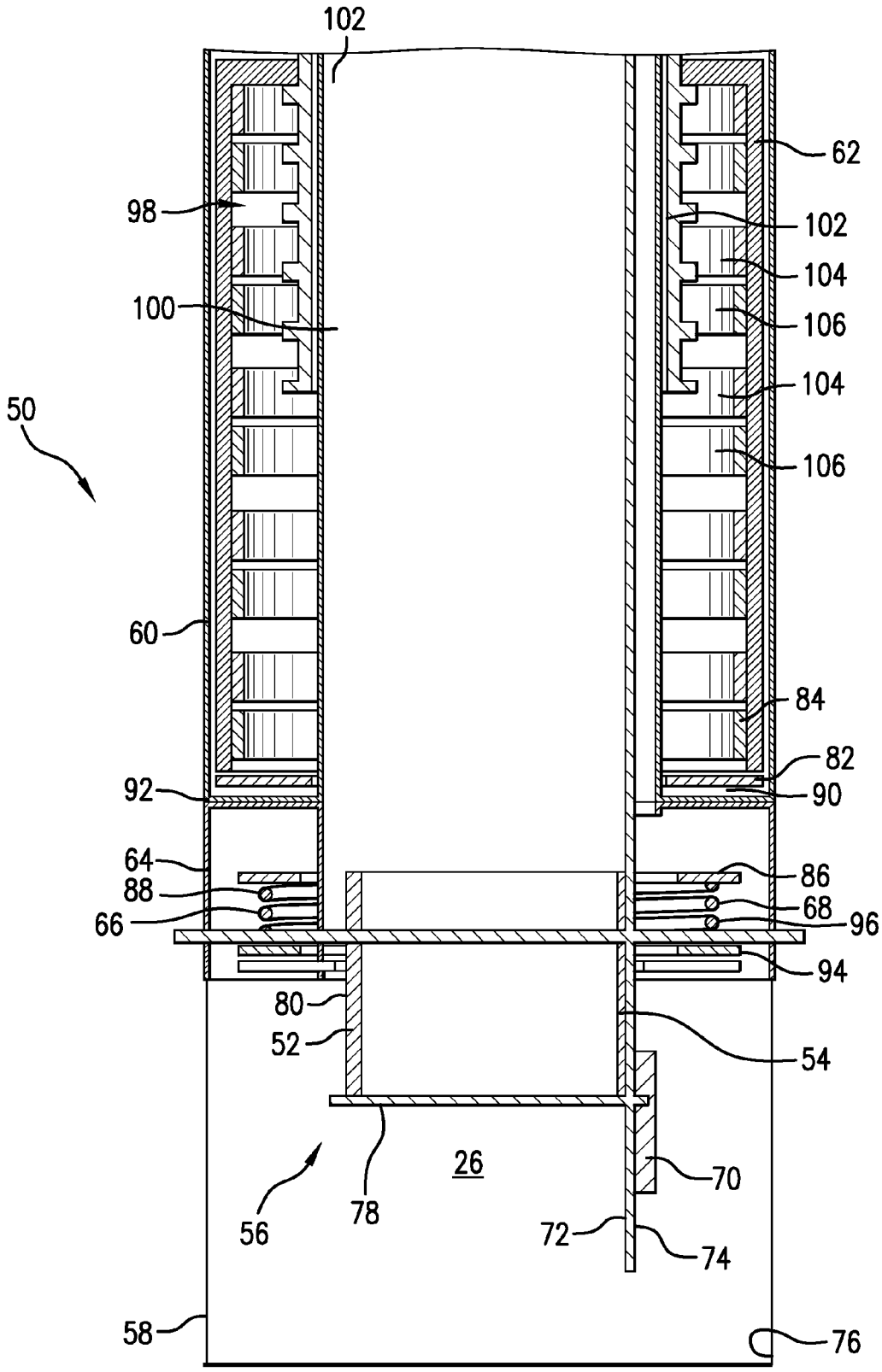
FIG. 3 depicts a cross sectional view of the downhole activation system of FIG. 3 with the closure mechanism shown in an open condition.
Figure 4:
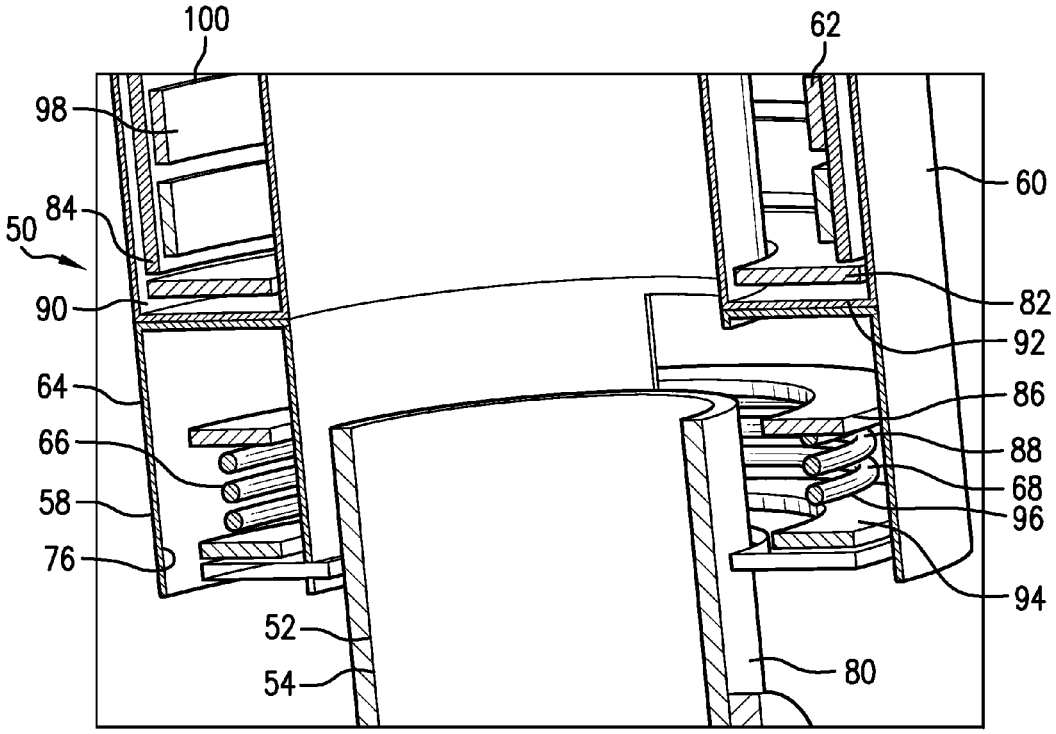
FIG. 4 depicts a perspective cutaway view of the downhole activation system of FIGS. 2 and 3; and, FIG. 5 depicts a cross sectional view of another exemplary embodiment of a downhole activation system used with a closure mechanism shown in an open condition.

Turning now to FIGS. 2-4, an exemplary embodiment of an activation system 50 having an activatable member 52 is shown. As illustrated, the activatable member 52 includes an axially movable flow tube 54 forming part of a closure mechanism 56. The closure mechanism 56 is usable as an SCSSV as described above with respect to FIG. 1, however the closure mechanism 56 may be used in other areas and systems requiring valve functions. Also, while the exemplary embodiments described herein are relevant to closure mechanisms, the activation system 50 to move the axially movable flow tube 54 may be incorporated for use in other downhole tools. For example, a tubular concentrically arranged with the flow tube 54 may include perforations that are hidden or accessed depending on an axial location of the flow tube 54.

The activation system 50 includes a tubular 58 with a central flowbore 26 that becomes a portion of the flowbore 26 of the production tubing string 22 of FIG. 1 when the tubular 58 is integrated into the production tubing string 22 of FIG. 1. A first housing 60 of the tubular 58 encloses an axially movable mover 62 within an inner annulus 63. The tubular 58 also houses, such as in a second housing 64, a biasing device 66 such as a power spring 68. The first housing 60 may be sealed off from the power spring 68, or second housing 64. A pivotable flapper member 70 is pivotally retained within a cavity in the tubular 58. The flapper member 70 is movable between an open position where the flapper member 70 lies in a flow direction of the flowbore 26 of the tubular 58, as depicted in FIG. 3, wherein fluid (such as liquid, gas, oil, slurry, etc.) can pass through the central flowbore 26, and a closed position, illustrated in FIG. 2, wherein flow through the flowbore 26 is blocked by the flapper member 70, which extends across a diameter of the flow tube 54. The flapper member 70 is biased toward the closed position shown in FIG. 2, typically by a torsional spring (not shown), in a manner known in the art.

The flapper member 70 includes a first surface 72 and an opposed second surface 74. In the closed position shown in FIG. 2, the first surface 72 faces an uphole direction, and the opposed second surface 74 faces the downhole direction. As is understood in the art, the uphole direction would be a direction closer to the surface 16, while a downhole direction would be opposite the uphole direction and further down the borehole 10. Typically, the flapper member 70 has a shape sized to block at least an interior perimeter of the flow tube 54, such as a substantially circular shape, so that, in the closed position shown in FIG. 2, flow is prevented from traveling past the flapper member 70. An area within the flow tube 54 uphole of the first surface 72 of the flapper member 70 in the closed position may have an inner diameter that is smaller than an outer diameter of the flapper member 70, such that when the flapper member 70 is closed as shown in FIG. 2, the flowbore 26 is completely blocked. As shown in FIG. 3, when the flapper member 70 is in the open position, the first surface 72 faces the flowbore 26 and the second surface 74 faces an inner wall of the tubular 58. While a flapper member 70 has been described, the activatable member 52 may also cooperate with a ball member, or other downhole tool, sleeve, etc.

The flow tube 54 is also disposed at least partially within the second housing 64 and is axially movable with respect to the second housing 64 between an uphole position shown in FIG. 2 and a downhole position shown in FIG. 3. In the embodiment where the closure mechanism 56 is used as a SCSSV, the flow tube 54 enables flow to continue through the flowbore 26 after the flapper member 70 has been pushed aside. The flow tube 54 may be biased toward the uphole position by the power spring 68. In such an embodiment, the power spring 68 is in an extended uncompressed condition and when the flow tube 54 is in the uphole position, the flapper member 70 is allowed to move to its own biased closed position shown in FIG. 2, such as by a torsion spring (not shown). Alternatively, the flow tube 54 may be biased toward a downhole position by the power spring 68 or other biasing device 66, in which case the arrangement of parts described herein would be reversed.

When power spring 68 is used to bias the flow tube 54 in the uphole position, the compressive bias must be overcome for the flow tube 54 to move downhole. The mover 62 is disposed uphole of the flow tube 54 and also moves in an axial direction to interact with the flow tube 54 as will be further described below. When the mover 62 is actuated to move in the downhole direction, a downhole end 78 of the flow tube 54 abuts with the first surface 72 of the flapper member 70, pivoting the flapper member 70 towards the inner wall 76 of the tubular 58. With the flow tube 54 retained in this downhole condition, the flapper member 70 is forced in the open position shown in FIG. 3 by being trapped between an outer surface 80 of the flow tube 54 and the inner wall 76 of the tubular 58.

An interaction between the mover 62 and the flow tube 54 will now be described. The interaction utilizes a property of two opposing magnets. When a distance between two magnets with opposing fields decreases, the repulsive forces increase. In an exemplary embodiment, a first magnet 82 is attached to a downhole end 84 of the mover 62, and is thus axially movable with the mover 62. A second magnet 86, downhole of the first magnet 82, is attached to an uphole end 88 of the power spring 68, and is thus biased in an uphole direction. Movement of the second magnet 86 in a downhole direction will be against the natural bias of the power spring 68 or other biasing device. While the first magnet 82 is described as on a downhole end 84 of the mover 62 and the second magnet 86 is described as downhole of the first magnet 82, the arrangement may be reversed so as to move a downhole biased activatable member 52 in an uphole direction. The first and second magnets 82, 86 may be annular shaped so as to allow flow through the flowbore 26, however the shape is not limited, for example, each of the first and second magnets 82, 86 may include one or more separate magnets spaced about the downhole end 84 of mover 62 and uphole end 88 of spring 68, as long as the resultant magnetic force therebetween is sufficient to accomplish activation of the activatable member 52 as described herein. Also, any of the magnets described herein need not be solid magnets if magnetic paint or coatings are strong enough to accomplish the required movements therebetween. The first and second magnets 82, 86 are oppositely polarized to have a same polarity facing each other such that they are magnetically repulsed by each other. Both the first and second magnets 82, 86 are magnetized in the axial direction.

As the mover 62 is moved axially downhole within the space 90 in the first housing 60, the repulsion between the first and second magnets 82, 86 will cause a compression on the power spring 68. The second magnet 86 is also coupled with the flow tube 54, and thus the flow tube 54 moves with the second magnet 86 and power spring 68. The mover 62 and the first magnet 82 are enclosed within the first housing 60, and separated from the second magnet 86 and power spring 68 by an enclosure interface 92, and therefore sealing friction between the mover 62 and the flow tube 54/power spring 68 is eliminated. Because of the enclosure interface 92, the first magnet 82 exerts force across the interface 92, yet cannot move axially downhole outside of the first housing 60. Therefore, the repulsive force between the first and second magnets 82, 86, as the spring 68 is compressed and the mover 62 is moved as far downhole within space 90 as it will go (and the flow tube 54 in turn moves away from the mover 62), will actually decrease as the first and second magnets 82, 86 are pushed apart. To compensate, a third magnet 94, which is of an opposing field facing the second magnet 86 and thus magnetically attracted to the second magnet 86, is placed on an opposite (downhole) end 96 of the spring 68 such that the second magnet 86 is attracted to the third magnet 94 and that magnetic force is exerted on the spring 68. The force of attraction between the second and third magnets 86, 94 is incapable of compressing the power spring 68 when the power spring 68 is in its biased uncompressed condition shown in FIG. 2.

The system 50 in FIG. 2 is shown in the off/closed position and the flapper member 70 is closed. There is minimal compression on the power spring 68 in the closed condition. As shown in FIG. 3, when the mover 62 is actuated (turned on), the mover 62 moves downhole and the first magnet 82 repulses the second magnet 86 to partially compress the power spring 68 such that the attraction between the second and third magnets 86, 94 increases enough to cause further compression of the power spring 68. The combination of magnetic forces ensures that there is sufficient compression on the spring 68 to push down on the flow tube 54, via the second magnet 86 coupled to the flow tube 54, and thereby open the flapper member 70 against its own spring bias. The third magnet 94 is at least slightly stronger than the second magnet 86 to ensure that the flapper member 70 is closed in its natural biased position. However, the third magnet 94 alone may not retain the second magnet 86 in a state of attraction to compress the spring 68. It is a combination of magnetic repulsion between the first and second magnets 82, 86 and magnetic attraction between the second and third magnets 86, 94 that activates the system. When the magnetic repulsion force between the first and second magnets 82, 86 is lost, then the spring 68 will decompress to deactivate the system. The magnetization of the first and second magnets 82, 86 are opposite, while the magnetization of the second and third magnets 86, 94 are the same. For example, the first magnet 82 may be polarized with a south pole on an uphole side and a north pole on a downhole side thereof, while the second and third magnets 86, 94 may be polarized with a north pole on an uphole side and a south pole on a downhole side thereof Of course, the polarization of the first, second, and third magnets 82, 86, 94 may also be reversed.

As the mover 62 and its attached first magnet 82 approach the interface 92, the coupled magnetic force exerted on the second magnet 86, which is outside of the first housing 60, begins to increase according to the following equation:

$$F_{12}=k(q_1q_2)/r^2$$

Where F is force, k is constant, q is charge, and r is separation distance between the first and second magnets 82, 86. As can be seen from the equation, as the distance r between the first and second magnets 82, 86 decrease, the repulsive force F (because they are like fields and will repel) increases. This repulsion will cause a compression on the spring 68 because the second magnet 86 is connected to the spring 68. The repulsive force, as the spring 68 is compressed, will actually decrease as the first and second magnets 82, 86 are pushed apart. To compensate, the third magnet 94 is used as described above. In order to allow the flapper member 70 to close, an actuator 98 of the mover 62 may provide the additional force that is capable of overcoming the third magnet 94 and ensure that the flapper member 70 remains closed. When the actuator 98, such as a motor 100, stops applying force (i.e. power is cut or turned off or lost for some reason), the closure mechanism 56 will slam shut.

FIG. 4 shows a close up of the enclosure interface 92. There is no need for pressure compensation in this system 50. Therefore, one benefit to this system 50 is that it reduces, and may completely eliminate, seal friction forces, which would then free up that equivalent amount of force to be used for actual force, not wasted due to friction.

The mover 62 may be powered to move in the axial uphole or downhole direction by any number of actuators 98 or actuating systems, including, but not limited to, electric, electromagnet, hydraulic system, battery, etc. In one exemplary embodiment, as shown in FIGS. 2-4, a motor 100 provides the motive force, the motor 100 including a stator 102 (FIGS. 2 and 3) and alternatingly polarized magnets 104, 106 as well as the mover 62. When the first magnet 82 is attached to the end of the mover 62, the motor 100 provides the force that is capable of moving the mover 62 and ultimately ensuring that the flapper member 70 remains open. When the motor 100 stops applying force (i.e. power is cut or turned off or lost for some reason), the mover 62 will move in a direction away from the power spring 68, and due to the loss of the magnetic repulsion force between the first and second magnets 82, 86, the second magnet 86 will move back in the uphole direction such that the magnetic attraction between the third magnet 94 and second magnet 86 will decrease and result in slamming the system shut, ensuring an important "Fail Safe Closed" feature. Thus, by removing a force that moves the mover 62 in the downhole direction allows the mover 62 to move in the uphole direction to deactivate the activatable member 52, such as the flow tube 54. A force between the first magnet 82 and the second magnet 86 in an inactivated condition of the mover 62 is inadequate to move the power spring 68 in a direction against its bias.

Figure 5:
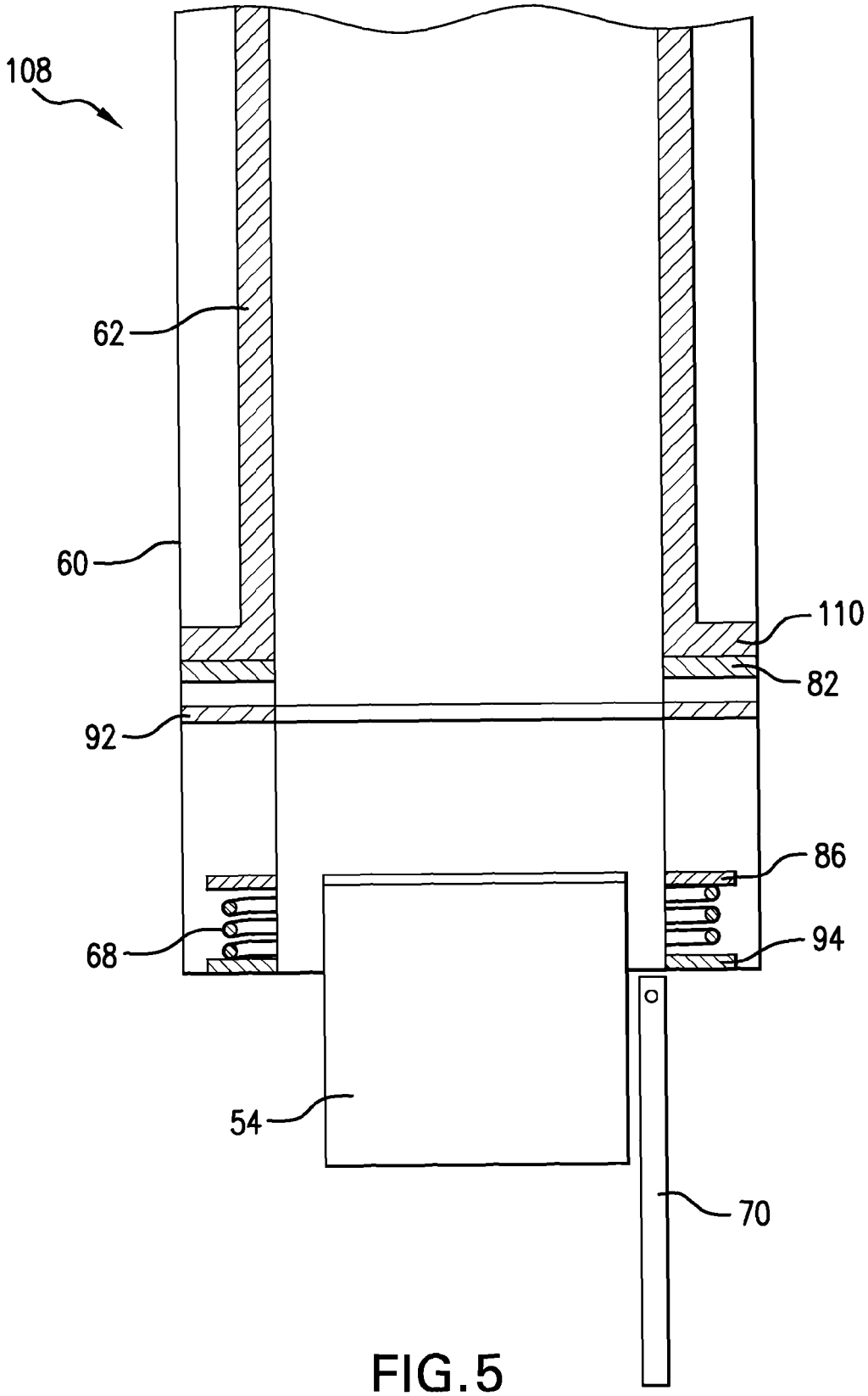

In another exemplary embodiment, as shown schematically in FIG. 5, the mover 62 is hydraulically activated by a hydraulic actuator 108 to move in the downhole direction by the pump 38 via the control line 36, as shown in FIG. 1. When the first magnet 82 is attached to a dynamic rod piston 110 instead of a motor 100, the applied hydraulic pressure acting on the rod piston 110 moves the piston 110 downhole and thus provides the additional force that is capable of initiating and maintaining an interaction between the first to third magnets 82, 86, 94 in a manner as previously described to ensure that the flapper member 70 remains open. In the event that the control line 36 is severed or hydraulic pressure is otherwise stopped or hampered, the rod piston 110 will no longer have the applied force to maintain the engagement of the third magnet 94 thereby allowing the power spring 68 to move back in its biased uncompressed condition to slam the system shut, again ensuring the important "fail safe closed" feature.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole activation system within a tubular, the system comprising:

an axially movable mover;

a first magnet attached to the mover, the first magnet axially movable with the mover;

a second magnet separated from the first magnet, the second magnet magnetically repulsed by the first magnet;

a biasing device urging the second magnet towards the first magnet; and a third magnet magnetically attracted to the second magnet, the biasing device interposed between the second and third magnets;

wherein movement of the first magnet via the mover towards the second magnet moves the second magnet in a direction against the biasing device.

2. The downhole activation system of claim 1, further comprising a first housing within the tubular enclosing an inner annulus, the axially movable mover and the first magnet enclosed within the first housing, and the second magnet separated from the first magnet by an enclosure interface of the first housing.

3. The downhole activation system of claim 2, the first housing sealed off from the second housing.

4. The downhole activation system of claim 2, wherein movement of the first magnet towards the second magnet is stopped by the enclosure interface.

5. The downhole activation system of claim 1, wherein the biasing device is a power spring.

6. The downhole activation system of claim 1, wherein a force of attraction between the second and third magnets is incapable of compressing the power spring in its biased uncompressed condition.

7. The downhole activation system of claim 6, wherein the power spring returns to the biased uncompressed condition when the mover moves in a direction away from the power spring.

8. The downhole activation system of claim 1, further comprising a flow tube coupled with the second magnet, the flow tube movable within the tubular with the second magnet.

9. The downhole activation system of claim 8, further comprising a closure mechanism, the closure mechanism opened upon movement of the flow tube away from the mover.

10. The downhole activation system of claim 9, wherein the closure mechanism includes a spring biased flapper member.

11. The downhole activation system of claim 9 wherein the tubular includes a downhole end and an uphole end, production fluid in the tubular moves from the downhole end to the uphole end when the closure mechanism is in an open configuration, and is blocked from movement in an uphole direction by the closure mechanism in a closed configuration.

12. The downhole activation system of claim 1, further comprising an activatable member coupled with the second magnet, the activatable member movable within the tubular with the second magnet.

13. The downhole activation system of claim 1, further comprising an actuator for the mover, the actuator including a motor.

14. The downhole activation system of claim l, further comprising an actuating system for the mover, the actuating system including a hydraulic system.

15. The downhole activation system of claim 1, wherein the first magnet is attached to a downhole end of the mover, and the second magnet is downhole of the first magnet and attached to an uphole end of the biasing device.

16. The downhole activation system of claim 1, wherein a force between the first magnet and the second magnet in an inactivated condition of the mover is inadequate to move the biasing device in a direction against its bias.

17. A method of activating an activatable member in a downhole tubular, the method comprising:

moving a mover, having a first magnet attached on an end thereof, in a first direction;

magnetically repulsing a second magnet, biased in a second direction opposite the first direction, in the first direction via the first magnet; and magnetically attracting the second magnet in the first direction via a third magnet;

wherein the activatable member is coupled to the second magnet and activated by movement of the second magnet.

18. The method of claim 17, further comprising providing the mover and first magnet in a housing sealed off from the second magnet and activatable member.

19. The method of claim 17, further comprising removing a force that moves the mover in the first direction and allowing the mover to move in the second direction to deactivate the activatable member.

* * * * *